United States Patent [19]

von Winckelmann

[11] 4,221,077

[45] Sep. 9, 1980

[54] TOY RACING CAR

[76] Inventor: Emil H. von Winckelmann, 7731 Amestoy St., Van Nuys, Calif. 91406

[21] Appl. No.: 949,970

[22] Filed: Oct. 10, 1978

[51] Int. Cl.[3] ..... A63H 18/12

[52] U.S. Cl. ..... 46/259; 46/262; 104/242

[58] Field of Search ..... 46/257, 258, 259, 262, 46/253, 251, 248; 273/86 B; 104/60, 242, 247, 243, 244.1

[56] References Cited

U.S. PATENT DOCUMENTS

| | | | |
|---|---|---|---|
| 2,555,793 | 6/1951 | Frye | 104/244.1 |
| 3,535,821 | 10/1970 | Ieda | 46/257 |
| 3,797,404 | 3/1974 | Barlow et al. | 46/259 X |
| 4,092,931 | 6/1978 | Wulf et al. | 104/242 X |

FOREIGN PATENT DOCUMENTS

| | | | |
|---|---|---|---|
| 1368193 | 6/1964 | France | 46/259 |

*Primary Examiner*—Louis G. Mancene
*Assistant Examiner*—Mickey Yu
*Attorney, Agent, or Firm*—Keith D. Beecher

[57] ABSTRACT

A toy racing car is provided which may be steered from one slot to another on a multi-slotted wide track. The car is electrically energized through electrically conductive strips extending along both sides of the slots either internally or externally of the slots, and the car has a solenoid operated pin which extends down into the slot to hold the car on course. The car may be turned in one direction or another by selecting the polarity of the voltage applied to the electric motor in the car, and the pin may be released from the slot by a high voltage pulse, or, alternately by the interruption of a high voltage, thereby permitting the car to be steered either to the left or to the right to the next adjacent slot on the track. The steering is accomplished in the illustrated embodiment by a gear train which causes one of the axles of the car to turn a limited amount in one direction or the other depending upon the polarity of the voltage applied to the motor, such a steering mechanism being disclosed and claimed in copending application Ser. No. 948,688.

6 Claims, 5 Drawing Figures

10
32
26
30
52
48
46

22
20
18
14
17
16
56
12
44
42
40
86
28
34
54
50
66
88
30
64
46
32
26
52
48
70
72
78
76
80
82
92
90

Track
Slot
Transformer & Rectifier
(-) 14V 28V
MOTOR

TOY RACING CAR

BACKGROUND OF THE INVENTION

Electrically energized toy racing cars are known which may be raced against one another. It is usual in the prior art to provide a track with side walls for use with such cars, and for the cars to be controlled so that they may be steered so as to be biased against one or the other of the side walls by selecting the polarity of the direct current voltage applied to the electric drive motor in each car, the voltage being applied through electrically conductive strips extending along the track. The prior art cars are steered by mounting the rear wheels to be individually rotatable on the rear axle, and by providing a somewhat complex gear train from the motor such that one or the other rear wheel is driven in the forward direction depending upon the direction of rotation of the motor which, in turn, depends upon the polarity of the direct current voltage applied to the motor.

Because the prior art tracks are limited essentially to two-lane, one adjacent to each of the side walls, the track must be relatively narrow, and racing is usually limited to two cars. By using the cars of the present invention, a multi-slotted wide track may be used, and any number of cars may be raced, depending upon the number of lanes provided in the track. In accordance with the concepts of the present invention, the control of each car is such that it can be accurately and consistently steered to any one of the lanes. Moreover, since there is no need for side walls, visibility and realism of the race is enhanced.

DETAILED DESCRIPTION OF THE ILLUSTRATED EMBODIMENT

Figures 1, 2:
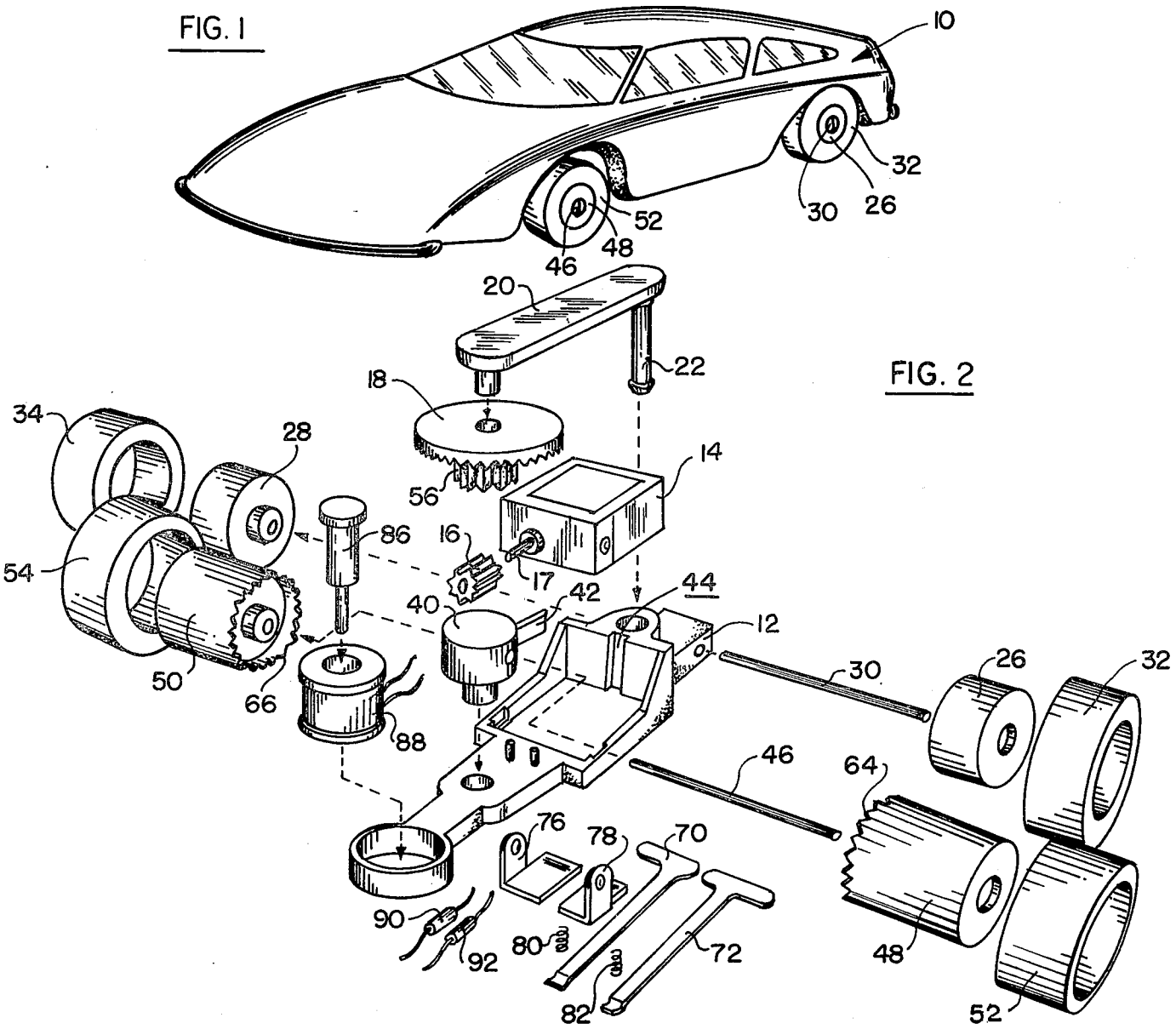
FIG. 1 is a perspective view of a toy racing car which may be constructed in accordance with the concepts of the present invention.
FIG. 2 is an exploded perspective representation of the internal mechanism of the car of FIG. 1, representing one embodiment of the invention.

The toy car shown in FIG. 1 is designated generally as 10. As shown in FIG. 2, the car 10 includes a chassis 12. An electric motor 14 is mounted on the chassis 12, and the motor drives a drive gear 16 through a drive shaft 17. Gear 16, in turn, engages a crown gear 18 which is mounted on the distal end of an arm 20, the arm being pivotally mounted on chassis 12 by means of a post 22.

The rear wheel hubs 26 and 28 of the car are mounted on an axle 30, and are clamped to the axle. Each wheel hub is provided with a tire, such as the tires 32 and 34.

A steering member 40 is mounted on chassis 12 for limited rotation about a vertical axis, rotation of the member being limited by a radial projection 42 which extends into a slot 44 in the chassis.

The vehicle has a front axle 46 which extends through the member 40, and front wheel hubs, such as the hubs 48 and 50 are mounted on the respective ends of the axle 46, and are clamped to the axle. Tires, such as the tires 52 and 54 are mounted on the hubs. A gear 56 is formed integral with the crown gear 18, and is positioned such that when the motor 14 is driven in one direction, the crown gear 18 causes the gear 56 to engage a crown gear 64 formed at one end of hub 48, and when the motor 14 turns in the opposite direction, the crown gear 18 causes the arm 20 to swing in the opposite direction so that the gear 56 engages a crown gear 66 formed at the inner end of hub 50.

Therefore, when the motor 14 is energized for rotation in a first direction, the gear 56 engages gear 64, causing the front wheel hubs 48 and 50 to turn in the forward direction, but with the axle 46 turned to steer the car in one direction; and when the direction of rotation of the motor 14 is reversed, the gear 56 engages the gear 66, again to cause the front wheels to turn in the forward direction, but to swing the axle 46 and steering member 40 such that the car is turned in the other direction.

Figures 3, 4, 5:
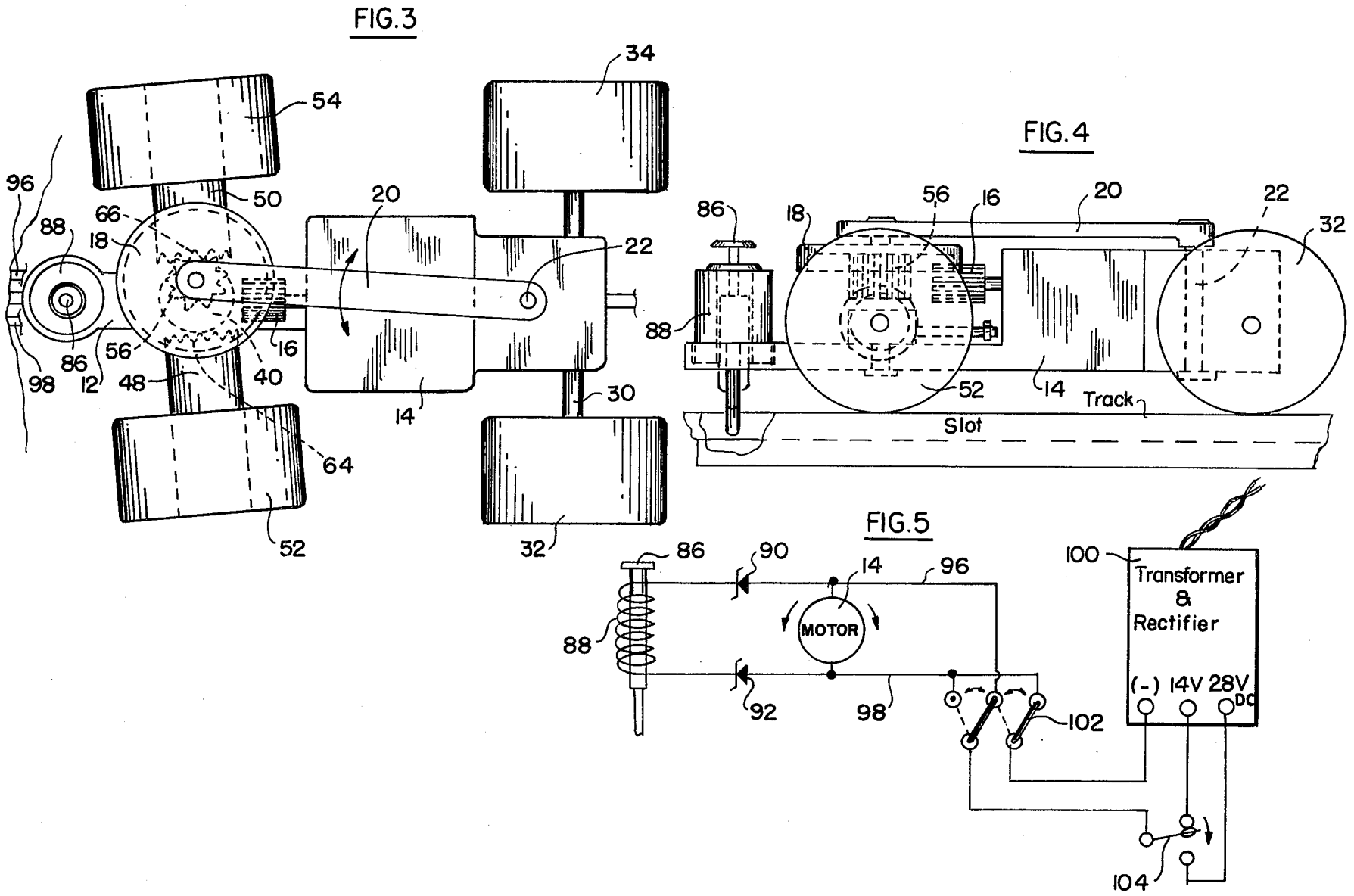
FIG. 3 is a top plan view in schematic form, showing the mechanism of the car of FIG. 1.
FIG. 4 is a side elevational view, in schematic form, of the mechanism of FIG. 3.
FIG. 5 is a circuit diagram showing the manner in which the car of FIG. 1 may be electrically controlled.

The motor 14 is energized by two contact sliders 70 and 72 which are connected respectively to contact plates 76 and 78, the contact plates being connected to the motor 14. The sliders 70 and 72 are spring-biased by springs 80 and 82 against electrically conductive strips 96, 98 which are provided on the track (FIG. 3). The motor 14 is a direct current motor, so that when a direct current voltage of a first polarity is applied across the strips, the motor is energized with a particular polarity and rotates in a first direction; and so that when a voltage of an opposite polarity is applied across the strips, the motor is energized to turn in the opposite direction, in this way steering may be effectuated as described above.

A rod 86 is supported in a solenoid coil 88 which, in turn, is mounted on chassis 12. A pair of Zener diodes 90 and 92 connect the solenoid coil to the contact plates 76, 78. As shown in FIGS. 3 and 4, the rod 86 normally rides in a slot that extends along the track, and the sliders 70 and 72 engage conductive strips 96 and 98 which extend externally of the slot along each side of the slot. The strips 96 and 98 may be mounted on the internal sides of the slotk if so desired. As shown in FIG. 5, a transformer and rectifier unit 100 is connected to the strips 96 and 98 through a reversing switch 102; the strips, in turn, being connected to the motor 14 and to the Zener diodes 90 and 92 through the sliders 70, 72 and contact plates 76, 78. The transformer and rectifier 100 also has a 28-volt DC terminal which may be connected to the strips when a pulse switch 104 is actuated.

To operate the car, the switch 102 is placed in one position or the other, so that the car may be driven forwardly along the track with pin 86 engaging one of the slots in the track. Then, should pulse switch 104 be operated, a high voltage pulse is applied across the strips 96 and 98 which is sufficient to break down the Zener diodes 90 and 92, so as to energize solenoid coil 88 and cause the rod 86 to be withdrawn from the slot. The car is then free to turn in one direction or the other, depending upon the position of switch 102. As the car turns away from the slot, it breaks its connection with the strips 96 and 98, and coasts either to the left or right to the next slot. As soon as the car reaches the next slot, the rod 86 drops into the slot, and electrical connection is re-established to its drive motor through the conductive strips positioned adjacent the latter slot. In this way, the car can be steered from slot-to-slot under the control of the operator.

It is to be understood that although the coupling between the car and any individual track is shown in the illustrated embodiment to be effectuated by a solenoid controlled rod which drops into a slot provided in each track, equivalent coupling assemblies could be used. For example, a central track of magnetic material may be formed, and a permanent magnet may be raised or lowered into coupled relationship with the central track. Also, an electromagnet could be used in conjunction with the central track, with the electromagnet being turned off, when it is desired to de-couple the car from the track. Moreover, the rod 86 in the illustrated embodiment may be spring-biased in its upper position, and driven to its lower position when the solenoid is energized, or may be moved to its upper position by the energizing of the solenoid, to drop to its lower position when the solenoid is de-energized.

Accordingly, it is evident that, although a particular embodiment of the invention has been shown and described, modifications may be made. It is intended in the claims to cover all modifications which come within the true spirit and scope of the invention.

What is claimed is:

1. A toy car and track combination, said track having a longitudinal slot therein for guiding the car along a selected lane thereof, said car including: a chassis, a drive motor mounted on the chassis; means for selectively coupling and decoupling the car to said track comprising a rod reciprocally movable to drop to a lower position in which the rod extends down into the slot and to be raised up to an upper position in which the rod is withdrawn from the slot; and a solenoid coil mounted on said chassis surrounding said rod to cause the rod to be withdrawn from the slot when the solenoid coil is energized thereby to cause the car to be decoupled from said longitudinal slot as the car is driven by the drive motor along the selected lane.

2. The combination defined in claim 1, and which includes steering means mounted on said chassis and controllable to permit the car to be steered from the selected lane to an adjacent lane on the track after the car has been de-coupled from the longitudinal slot.

3. The combination defined in claim 1, in which said track has electrically conductive strips extending along each side of the slot, and in which said drive motor is electrically energized, and said car includes electrically conductive sliders mounted on said chassis in position slidably to engage the conductive strips, said sliders being electrically connected to the motor.

4. The combination defined in claim 3, and which includes means connecting said solenoid coil to said sliders.

5. The combination defined in claim 4, in which said last-named means includes voltage threshold responsive means enabling the solenoid coil to be energized in response to voltage pulses above a certain threshold.

6. The combination defined in claim 3, in which said car has front and rear wheels thereon, and a gear train coupling the drive motor to at least some of said wheels to cause the car to turn in one direction or the other after the rod has been withdrawn from the slot depending upon the polarity of voltage applied to the conductive strips.

* * * * *